United States Patent [19]

Lowe

[11] 4,413,389

[45] Nov. 8, 1983

[54] RELEASABLE BUCKLE STRUCTURE AND METHOD

[75] Inventor: Greg E. Lowe, Ogden, Utah

[73] Assignee: Lowe Alpine Systems, Inc., Lafayette, Colo.

[21] Appl. No.: 225,826

[22] Filed: Jan. 19, 1981

[51] Int. Cl.[3] ..... A44B 11/28

[52] U.S. Cl. ..... 24/312; 24/698

[58] Field of Search ..... 24/201 R, 225, 226, 24/227, 201 HE, 20 CW, 20 EE, 23 EE, 310, 311, 308, 312

[56] References Cited

U.S. PATENT DOCUMENTS

| | | | |
|---|---|---|---|
| 347,094 | 8/1886 | Dielpy | 24/226 |
| 991,287 | 5/1911 | Feingold | 24/226 |
| 1,142,842 | 6/1915 | Rehm . | |
| 1,514,462 | 3/1924 | Ritter . | |
| 2,074,036 | 3/1937 | Ward | 24/226 |
| 2,101,585 | 12/1937 | LaVigne | 24/225 |
| 2,292,553 | 8/1942 | Versoy . | |
| 2,563,809 | 8/1948 | Ash . | |
| 2,784,472 | 3/1954 | Freysinger . | |
| 2,807,852 | 9/1953 | Rave . | |
| 2,809,408 | 10/1957 | Goldstein | 24/312 |
| 2,853,757 | 4/1954 | Rave . | |
| 3,060,537 | 10/1959 | Hatfield . | |
| 3,127,652 | 4/1962 | Springer . | |
| 3,189,961 | 6/1965 | Hellier | 24/20 CW |
| 3,222,739 | 12/1965 | Davis . | |
| 3,231,953 | 3/1962 | McHenry . | |
| 3,266,110 | 6/1965 | Davis . | |
| 3,407,452 | 12/1966 | Abert et al. . | |

*Primary Examiner*—Paul J. Hirsch

*Attorney, Agent, or Firm*—O'Rourke & Harris

[57] ABSTRACT

A releasable buckle structure and method in which a curved planar engaging member releasably interlocks with a curved planar receiving member, the engaging member having a U shaped opening defined therein and the receiving member having a complementary U shaped solid portion adapted to engage the U shaped opening with the projecting center portion of the U shaped opening extending through the open center of the U shaped solid portion with the solid portion bearing on the concave side of the curved engaging member, the engaging member including a handle portion which, when angularly displaced, induces the solid portion to ride along the concave curved surface of the engaging member until releasing through the slot defining the bottom of the U shaped opening, both the engaging member and the receiving member including means to engage separate belt ends and, in a preferred embodiment, including a narrowed slot at the bottom of the U shaped opening and a displaced center portion of the U shaped opening to reduce the possibility of inadvertent release during nontension situations between the engaging member and the receiving member.

13 Claims, 4 Drawing Figures

RELEASABLE BUCKLE STRUCTURE AND METHOD

BACKGROUND OF THE INVENTION

1. Field of the Invention

The present invention relates generally to releasable buckles which are conventionally positioned at at least one end of a strap or a web member and which may be conveniently secured together by interlocking such rigid buckles members, but conveniently released by manipulating the buckle member. More particularly the present invention relates to a releasable buckle structure and method in which an engaging member and a receiving member are interlocked with the receiving member including a U shaped portion having an open center adapted to receive a projection defined by a U shaped opening in the engaging member, both of the engaging member and receiving member being of a planar, curved configuration with the receiving member bearing upon the concave surface of the engaging member when in tension. Release is preferably accomplished by grasping and rotating the engaging member relative to the receiving member such that the receiving member rides along the curved surface, and ultimately exits at the slot defined at the bottom portion of the U shaped opening to release the buckle members.

2. Description of the Prior Art

Numerous releasable buckle structures are known. These buckles generally involve several important features, the most important of which are generally strength in tension, reliability of release when manipulated for that purpose, i.e., freedom from "hang-up", and convenience in interlocking the buckle members together. Among the simplist of such releaseable buckles is that illustrated in U.S. Pat. No. 1,142,842. While the "hooked end" releasable buckle illustrated is convenient to use and economic in structure, the open loop is subject to straightening under tension, and accordingly strength under tension is minimal.

U.S. Pat. Nos. 2,292,553 and 3,222,739 are illustrative of more complex releasable buckles which afford greater strength. For instance, as illustrated in FIGS. 4 through 8 of the first listed patent, an engaging member 21 is adapted to be received in slot 29, and when under tension, as illustrated in FIG. 8, provide a mutually reinforcing interface. While the patented releasable buckle is strong in tension and secure, as a result of the interlocking function of shoulder 28, disengagement is awkward in that the two buckle members must be rotated relative to one another with no convenient provision for such movement, and the members also must move laterally relative to one another for disengagement. This will generally require a positive, two handed operation which comprises convenience of release. The latter listed patent avoids this problem by providing a pivoting action when handle 34 is pulled, but again the device is subject to a hang-up in that T head 13 must move symmetrically into slot 12 upon release, or the undercut portion of T-head 13 may remain engaged on one side or the other of slot 12. Thus while the release action is convenient and operable with one hand, lateral shift of one member relative to the other during release can cause T-head 13 to hang-up in slot 12.

SUMMARY OF THE INVENTION

The present invention, which provides a heretofore unavailable means and structure for accomplishing a secure engagement in a releasable buckle while affording one handed sure disengagement of the releasable buckle, involves two members, an engaging member and a receiving member, the engaging member being of a substantially planar structure and concave on one side thereof with a U shaped opening defined therein to further define a engaging projection at the center of the U shaped opening, and the receiving member also being of a substantially planar construction including a complementary U shaped solid portion with an opening defined in the center thereof and adapted to receive the engaging projection of the engaging member. Preferably, the engaging member further includes a handle portion such that the engaging member may be grasped at the handle portion with one hand, and rotated relative to the receiving member to move the receiving member along the concave surface of the engaging projection until the receiving member readily exits in a foolproof manner from the slot defined at the bottom of the U shaped opening. In a specialized embodiment, the slot at the bottom of the U shaped opening may be narrowed and the engaging projection reformed to a flatter configuration to minimize inadvertent release, the slot of course being thick enough to pass the thickness of the U shaped solid portion when the engaging member is substantially normal to the receiving member. Both the engaging member and the receiving member include conventional means for attachment to the end portions of straps, webs etc., as is well known in the art.

Accordingly, an object of the present invention is to provide a new and improved releasable buckle structure and method which provide for great strength in tension when two rigid members of the releasable buckle are engaged.

Another object of the present invention is to provide a new and improved releasable buckle structure and method which may be quickly and conveniently released with one hand even while the buckle is under substantially tension.

Yet another object of the present invention is to provide a new and improved releasable buckle structure and method which releases in a foolproof manner with no possibility of "hanging-up" during the release operation.

Still another object of the present invention is to provide a new and improved releasable buckle structure and method which, when particularly configured, minimizes the possibility of inadvertent release when the buckle members are under loose or nonexistent tension.

These and other objects and advantages of the present invention will become apparent from the following drawings and description.

DETAILED DESCRIPTION OF THE INVENTION

Figure 1:
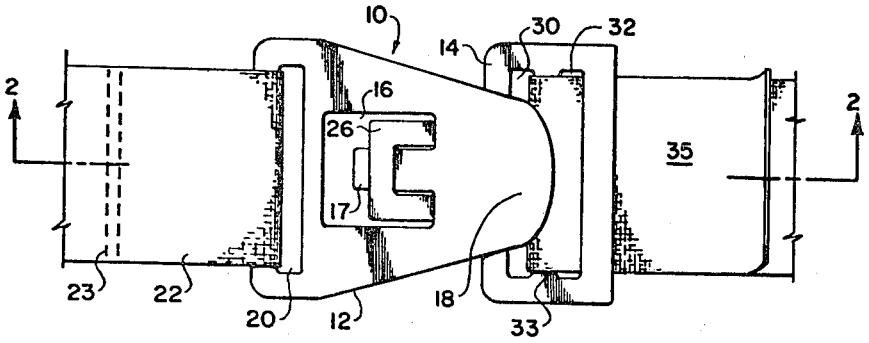
FIG. 1 is a top view of a releasable buckle structure in accord with the instant invention.
Figure 2:
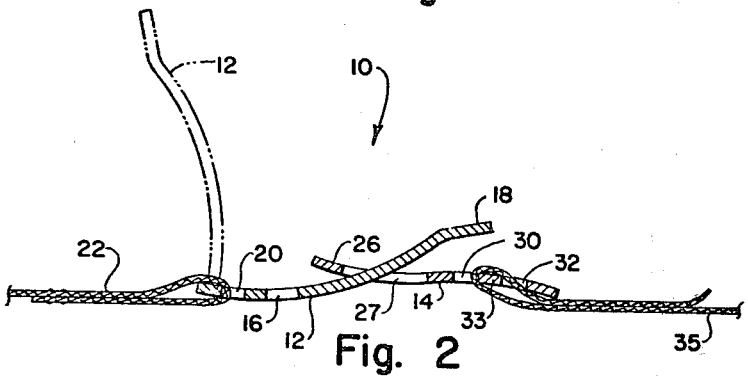
FIG. 2 is a side sectional view of the releasable buckle structure illustrated in FIG. 1 taken along section line 2—2.

Turning now to the drawings, wherein like components are designated by like reference numerals throughout the various FIGURES, a releasable buckle is illustrated in FIGS. 1 and 2 and generally designated by reference numeral 10. As illustrated, buckle 10 comprises an engaging member 12, and a receiving member 14. U shaped opening 16, defining engaging projection 17, is defined in engaging member 12 with, in the illustrated example, engaging member 12 and engaging projection 17 lying substantially in the same plane and defining a concave surface on a common side of each. Release handle 18 is defined at one extreme of engaging member 12, and strap slot 20, adapted to receive strap 22 therein, with strap 22 being securable by, for instance, stitching 23, such as to attach engaging member 12 to strap 22.

Receiving member 14 includes at an end portion thereon U shaped portion 26 defining a receiving opening 27 adapted such that engaging projection 17 fits within receiving opening 27, and the side legs of U shaped portion 26 fits within the side leg openings of U shaped opening 16. Also, in the embodiment illustrated, receiving member 14 includes slots 30 and 32, defining bar 33 there between such that strap 35 may be threaded up through slot 30, over bar 33, and down through slot 32 to provide a rudimentary adjustable strap interface. In operation, when in tension, U shaped portion 26 fits snugly against the root of engaging projection 17, thereby providing for great strength in tension. However, when release is desired, handle 18 may be grasped and moved to the position shown in ghosted fashion in FIG. 2. When this occurs, U shaped portion 26 rides along concave surface of engaging projection 17 until the bottom portion of U shaped projecting 26 is brought into the vicinity of the bottom of U shaped opening 16, at which point engaging member 12 and receiving member 14 will be at a substantial angle to one another, such that U shaped portion 26 will pass through the slot at the bottom portion of U shaped opening 16, thus providing for release. It is to be noted that no undercut surfaces are to be found anywhere in either of engaging member 12 or receiving member 14 which might give rise to a hang-up condition during such release manipulation. Also the further U shaped portion 26 rides towards release along engaging projection 17, the greater the mechanical advantage becomes. This aids in overcoming greater tension which may be induced by the release motion.

Figure 3:
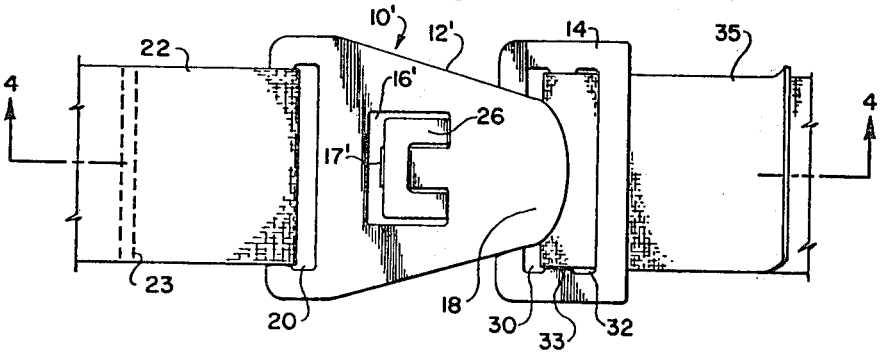
FIG. 3 is a view similar to that of FIG. 1 in which the releasable buckle is particularly configured to avoid inadvertent release.
Figure 4:
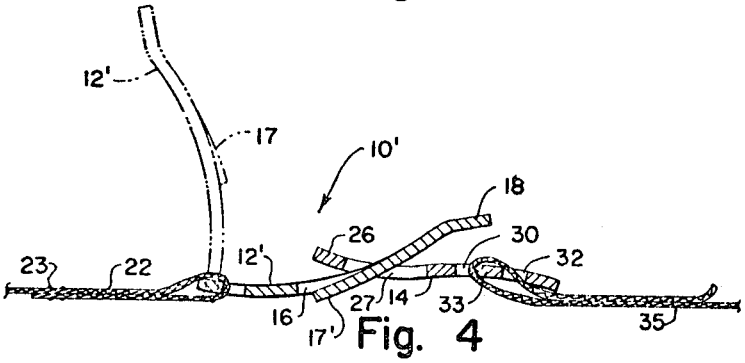
FIG. 4 is a side sectional view of the releasable buckle structure illustrated in FIG. 3 taken along section line 4—4.

Various modifications in the specific structure may be provided for differing purpose. For instance, in the embodiment of FIGS. 1 and 2, the slot forming the bottom portion of the U shaped opening 16 is quite wide to facilitate engagement, but may be subject to release if engaging member 12 and receiving member 14 move towards one another under a slack condition without the rotation normally found with the desired release operation. However, the embodiment of FIGS. 3 and 4, which is modified somewhat to optimize resistance to inadvertent release, may be instead utilized. In the embodiment of FIGS. 3 and 4, the substantially identical features are labeled with identical reference numerals to those of the embodiment of FIGS. 1 and 2, while the modified portions are indicated with a reference numeral prime.

As shown in FIGS. 3 and 4, releasable buckle 10' is again comprised of engaging member 12' and receiving member 14. However, the slot forming the bottom portion of U shaped openings 16' defined in engaging member 12' is, as will be observed, much narrower than that of the embodiment of FIGS. 1 and 2. As a minimum, the width of such slot at the bottom of U shaped opening 16' and engaging projection 17' must be equal to the thickness of U shaped portion 26, though in most cases it will be at least marginally greater than such thickness.

Also, engaging projection 17' is less concave or even straight, relative to the curved plane of engaging member 12 proper. It is preferred that some concave curvature be maintained in engaging projection 17' to facilitate the appropriate positioning of U shaped portion 26 during the release operation.

Otherwise, handle 18, and the interface with straps 22 and 35 at slots 20, 30 and 32 are substantially identical in the two embodiments. In operation, with particular reference to FIG. 4, it will be seem that as engaging member 12' and receiving member 14 move towards one another without rotation, i.e., as in a slack condition in straps 22 and 35, engaging projection 17' will tend to ride under the edge defining the bottom slot of U shaped opening 16', while the bottom portion of U shaped portion 26 will tend to ride over the concave surface forming the upper edge of the bottom slot of the U shaped opening 16' since the width of the lower portion of U shaped portion 26 is greater than the width of the slot at the bottom of U shaped opening 16'. Thus, in the slack configuration, U shaped portion 26 will be maintained in an interlocking relationship with engaging member 12'. When the engaging member 12' and the receiving member 14 again return to a tension configuration, the less curved engaging projection 17' will tend to re-engage the receiving opening 27 defined in the U shaped portion 26 thereby re-establishing the interlocking relationship specifically illustrated in FIGS. 3 and 4. On the other hand, under such conditions, it is possible that with regard to the configuration of FIGS. 1 and 2, under a slack condition, U shaped portion 26 could pass laterally through the slot defining the bottom portion of U shaped opening 16, thus providing for possible inadvertent disengagement of engaging member 12 and receiving member 14 under slack conditions.

In the event disengagement is desired with regard to the embodiment of FIGS. 3 and 4, again handle 18 is grasped and engaging member 12' rotated relative to receiving member 14 to the position shown in ghosted fashion. As this happens, the bottom portion of U shaped projection 26 moves along the preferably concave surface of engaging projection 17' until tension brings the bottom portion of U shaped projection 26 to the slot defining the bottom portion of U shaped opening 16'. Since, at this time, engaging member 12' and receiving member 14 will be in a relationship approaching a right angle, the thickness of the bottom portion of U shaped portion 26 may readily pass through the relatively narrow slot defining the bottom of U shaped opening 16'. Thus, in the embodiment of FIGS. 3 and 4, in addition to bringing the bottom of U shaped projection 26 into the vicinity of the slot forming the bottom of U shaped opening 16', a further requirement of an appropriate orientation between engaging member 12' and receiving member 14 is required to accomplish release. In this manner, very little convenience in engaging and disengaging releasable buckle 10' is incurred while providing for enhance protection against inadvertent release.

In summary, the instant invention provides a two piece releasable buckle structure which affords substantial strength in tension, convenient one-handed release manipulation with essentially no chance of inadvertent "hand-up" of the engaging and receiving members during the release operation. As a function of the purpose to which the releasable buckle is put, the buckle may be configured to optimize convenient engagement or optimize resistence to inadvertent release under slack conditions, or a compromise between the two extremes. It is contemplated that the buckle may be formed of metal, such as by stamping or other means, molded of plastic, or produced in any of the many means apparent to those skilled in the art.

Only limited embodiments of the invention have been illustrated and described with any degree of detail, but it is, however, anticipated that various changes and modifications will be apparent to those skilled in the art, and that such changes may be made without departing from the scope of the invention as defined by the following claims.

What is claimed is:

1. A releasable buckle structure comprising:

an engaging member of a curved, planar configuration having attachment means defined at one end thereof and a release handle defined at the opposite end thereof, the engaging member further including a U shaped opening defined therein between the attachment means and the release handle portion, the U shaped opening defining an engaging projection centrally thereof, a receiving member of a planar configuration having attachment means defined at one end thereof and a U shaped portion at the opposite end thereof, the U shaped portion having a receiving opening defined centrally therein, the engaging projection of the engaging member being adapted to fit within the receiving opening of the receiving member with the side legs of the U shaped portion of the receiving member being adapted to fit within the side legs of the U shaped opening defined in the engaging member;

whereby the engaging member and receiving member may be releasably secured together with the engaging projection of the engaging member fitting within the U shaped portion of the receiving member, the structure further being releasable by pulling upon the release handle thereby rotating the engaging member and causing the U shaped portion of the receiving member to ride along the engaging projection to ultimately provide release by disengaging the U shaped portion through the bottom of the U shaped opening.

2. A releasable buckle structure as set forth in claim 1 in which the engaging projection includes a concave surface adapted to receive and slidably support the U shaped portion of the receiving member, whereby as the engaging member is rotated for release, the U shaped portion of the receiving member is induced to progressively move along the concave surface to facilitate release.

3. A releasable buckle structure as set forth in claim 1 in which the attachment means defined in one of the engaging member and the receiving member comprise at least one slot defined transversely adjacent the end of such member and adapted to receive a web length.

4. A releasable buckle structure as set forth in claim 3 in which at least one of the attachment means comprise at least two slots defined adjacent one another and adapted to receive a web length in an adjustable relationship.

5. A releasable buckle structure as set forth in claim 1 in which the U shaped opening defined in the engaging member includes a slot defining the bottom of such opening, such slot being of a width greater than the width of the leg connecting end of the U shaped portion of the receiving member.

6. A releasable buckle structure as set forth in claim 1 in which the U shaped opening defined in the engaging member includes a slot defining the bottom of such opening, and the U shaped portion defined on the receiving member includes a bar defining the leg connecting end thereof, the slot being of a dimension less than the width of the bar member between the outer portion thereof and the receiving opening defined thereby, but greater than the thickness of the bar.

7. A releasable buckle structure as set forth in claim 1 in which the engaging projection is displaced from the plane of the engaging member in a direction away from the concave side thereof, the engaging projection having, on the same side thereof as the engaging member, a concave surface.

8. A releasable buckle structure as set forth in claim 1 in which the buckle structure is formed of metal.

9. A releasable buckle structure as set forth in claim 1 in which the buckle structure is formed of a polymeric material.

10. A releasable buckle structure comprising :

an engaging member of a curved, planar configuration having at least one slot defined adjacent one end thereof, and a release handle defined at the opposite end thereof, the engaging member further having a U shaped opening defined between the slot and the release handle with the side legs of the U shaped opening extending substantially perpendicular to the direction of the slot and defining an engaging projection centrally of the U shaped opening, a receiving member of a curved, planar configuration having at least one slot defined transversely adjacent one end thereof and a U shaped portion extending therefrom at the opposite end thereof, the U shaped portion defining a receiving opening centrally thereof;

the engaging projection of the engaging member having substantially linear sides free of undercuts and being adapted to fit within the receiving opening of the U shaped portion of the engaging member with the convex side of the receiving member bearing upon the concave side of the engaging projection of the engaging member, and further with the side legs of the U shaped portion fitting within the side legs of the U shaped opening.

11. A releasable buckle structure as set forth in claim 10 in which the width of the slot defining the bottom of the U shaped opening is greater than the thickness of the U shaped portion of the receiving member.

12. A method of securing and releasing a releasable buckle structure comprising:

positioning an engaging projection defining in part a U shaped opening in an engaging member of a curved, planar configuration within a central receiving opening defined within a U shaped portion of a separate receiving member to secure the engaging member and the receiving member under tension, and releasing the structure by rotating the engaging member relative to the receiving member to cause the U shaped portion of the receiving member to ride along the engaging projection and release therefrom by passing through the slot defining the bottom portion of the U shaped opening.

13. A method of securing and releasing a releasable buckle structure as set forth in claim 12 in which the receiving opening bears upon the concave surface of the engaging projection.

* * * * *